US005207392A

United States Patent [19]

Stangenberg et al.

[11] Patent Number: 5,207,392

[45] Date of Patent: May 4, 1993

[54] CUTTING MECHANISM FOR A DOCUMENT SHREDDER

[75] Inventors: Hartmut Stangenberg, Owingen; Rolf Gasteier, Markdorf, both of Fed. Rep. of Germany

[73] Assignee: Schleicher & Co. International Aktiengesellschaft, Fed. Rep. of Germany

[21] Appl. No.: 670,054

[22] Filed: Mar. 15, 1991

[30] Foreign Application Priority Data

Mar. 17, 1990 [DE] Fed. Rep. of Germany ..... 4008659

[51] Int. Cl.[5] ..... B02C 18/06

[52] U.S. Cl. ..... 241/236; 83/500

[58] Field of Search ..... 241/236; 83/500, 676

[56] References Cited

U.S. PATENT DOCUMENTS

| | | | |
|---|---|---|---|
| 1,512,929 | 10/1924 | Himoff | 241/236 |
| 4,165,043 | 8/1979 | Higashi et al. | 241/236 |
| 4,172,400 | 10/1979 | Brierly | 83/500 |
| 4,230,282 | 10/1980 | Haase | 241/159 |

FOREIGN PATENT DOCUMENTS

| | | | |
|---|---|---|---|
| 863862 | 1/1953 | Fed. Rep. of Germany | 241/236 |
| 1953681 | 11/1970 | Fed. Rep. of Germany . | |
| 1943648 | 3/1971 | Fed. Rep. of Germany | 241/236 |
| 2755898 | 6/1978 | Fed. Rep. of Germany . | |
| 2827544 | 1/1980 | Fed. Rep. of Germany . | |
| 8813569 | 2/1989 | Fed. Rep. of Germany . | |
| 47-21393 | 6/1972 | Japan | 241/236 |
| 1552269 | 9/1979 | United Kingdom . | |

*Primary Examiner*—Mark Rosenbaum
*Assistant Examiner*—John M. Husar
*Attorney, Agent, or Firm*—Quarles & Brady

[57] ABSTRACT

A cutting mechanism (11) for torsion cut has two cutting rollers (12, 13), cutting disks (14, 15), which in each case have a steep cutting face (22) and a sloping back face (23). The transitions between the latter and the roller body are generously filleted and the ratios between the cutting disk spacing, height, etc. are such that the opening (29) for the cut strips (28) has a compact and well rounded shape, so that the strips do not tend to get caught.

26 Claims, 1 Drawing Sheet

FIG. 1
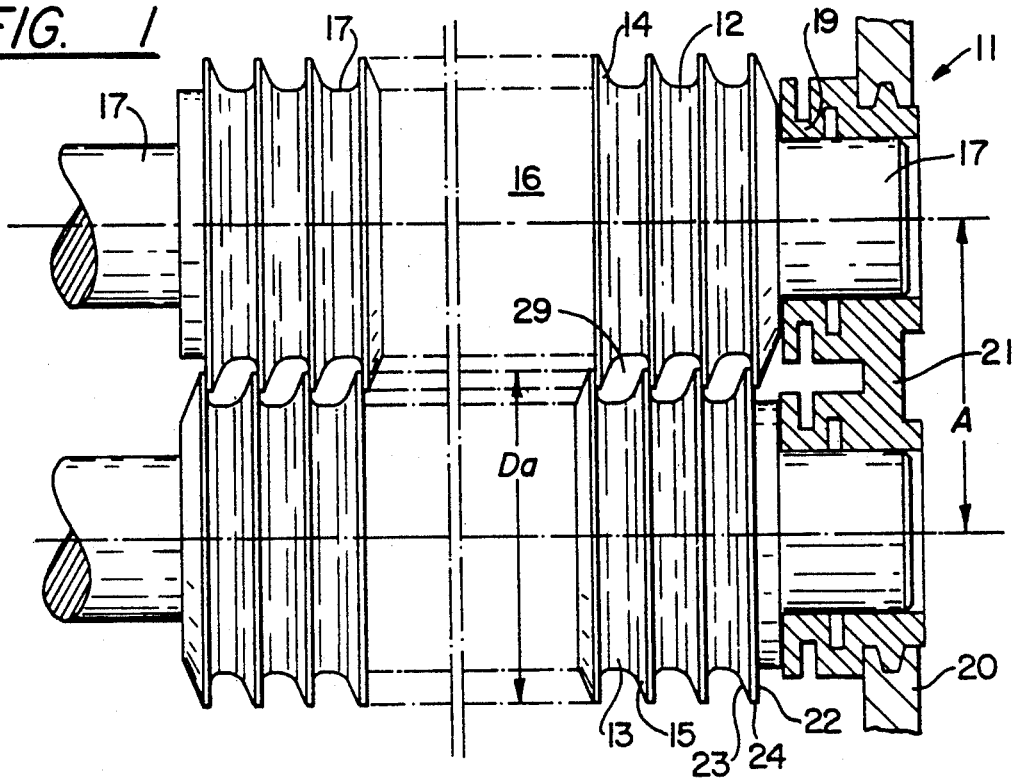
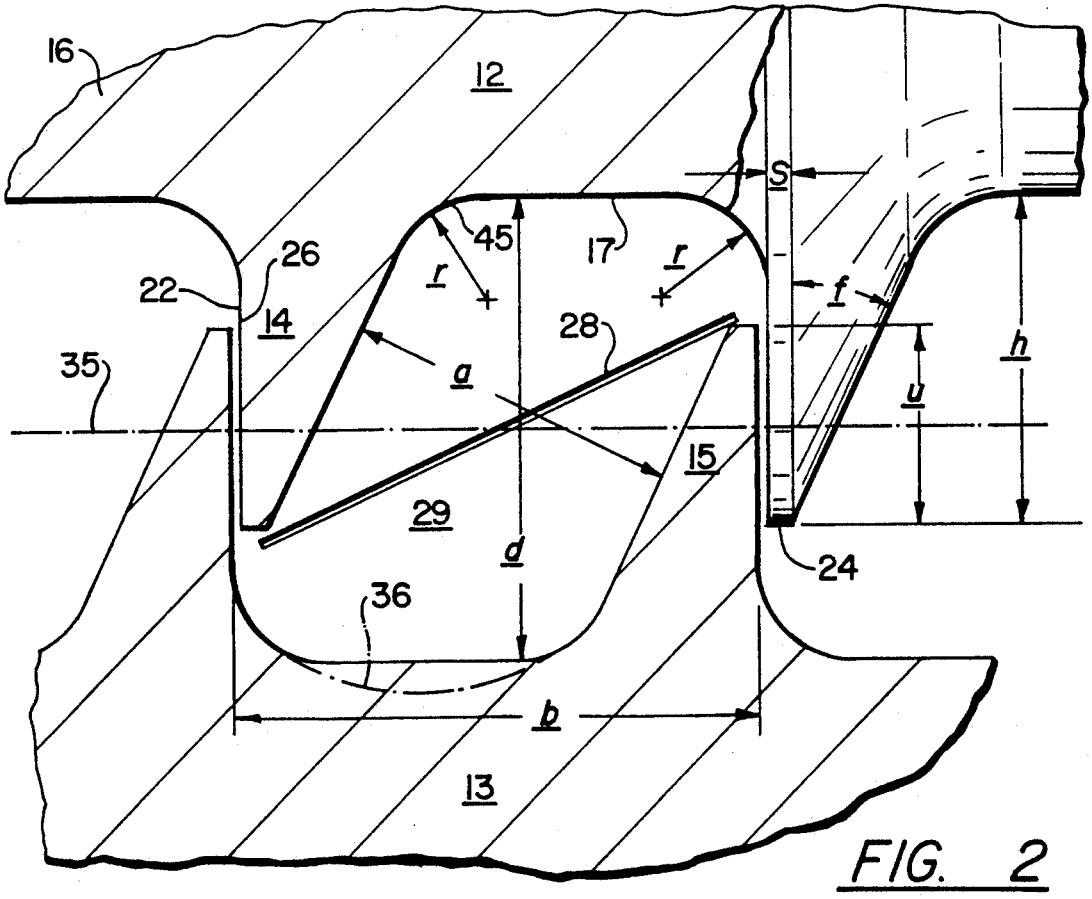
FIG. 2

CUTTING MECHANISM FOR A DOCUMENT SHREDDER

DESCRIPTION

1. Field of the Invention

The invention relates to a cutting mechanism for a document shredder.

2. Background of the Invention

The term document shredder is here understood to mean an apparatus mainly intended for cutting up into illegible strips written matter and other flat material, particularly paper. However, it can also be used for cutting up other objects.

A cutting mechanism of the aforementioned type is known from DE-C-19 53 681. It produces a so-called torsion or twisting cut, i.e. it cuts the written matter into narrow strips, which assume a more or less pronounced helical shape, because the two edges of the strip are deflected into different directions after cutting.

Compared with other cutting mechanisms with torsion cut that according to DE-C-19 53 681 has the advantage that even when cutting several layers of paper, the opening formed between in each case two pairs of cutting disks, provides adequate space for the strip to pass freely through the same. However, a problem occurs due to the relatively significant cutting disk height over the roller surface, because as a result the cutting disks are sensitive to breaking and consequently there are increases in the roller diameter, the roller gap and consequently the space required, together with construction costs. In addition, strips may stick to the cutting disks and be carried around the latter, so that usually strippers are needed in order to prevent them from winding around the cutting rollers.

SUMMARY OF THE INVENTION

An object of the present invention is to so improve a cutting mechanism of the aforementioned type that, while giving good cutting results, minimum energy costs and a limited breaking risk, a strip passage is possible without there being any tendency of the strips to become caught on the rollers. The compact trapezoidal shape of the opening makes it possible for the strip to assume virtually any random position. Its helix formation tendency is reduced and even on cutting material which tends to be subject to edge expansion on cutting, the resulting wavy cutting edges can pass in unimpeded manner through the opening. Together with moderate overlap and low depths of teeth, the energy consumption is also low.

The compact trapezoidal shape can be further defined on the basis of different criteria, which are given in the subclaims. However, they are also to be understood in alternative form as a result of the different construction modes, although a particularly advantageous embodiment can use them in combination, because they do not reciprocally exclude one another. It is also important to have a generous fillet at the transition between the cutting and back faces of each cutting disk and the roller surface. It has been found that this significantly reduces the jamming tendency of the strips, although this did not initially appear to be credible, because it somewhat reduces the largest diagonal dimension in the opening.

BRIEF DESCRIPTION OF THE DRAWINGS

These and further features of preferred developments of the invention can be gathered from the claims, description and drawings, in which the individual features can be realized in an embodiment of the invention and in other fields, either singly or in the form of random subcombinations and represent advantageous and independently protectable constructions for which protection is hereby claimed. Embodiments of the invention are described in greater detail hereinafter relative to the drawings, wherein show:

FIG. 1 A partial side view of a cutting mechanism with two cutting rollers.

FIG. 2 A detail section from the engagement area of the two cutting rollers.

DETAILED DESCRIPTION OF THE PREFERRED EMBODIMENTS

FIG. 1 shows a cutting mechanism 11 with two cutting rollers 12, 13, which in each case comprise a roller body 16 with cutting disks 14, 15 constructed in one piece thereon. The roller bodies have on either side a pivot pin 18, which are mounted in bearings 19 on a machine frame 20 of a document shredder, whereof further details are not shown. The left-hand pivot pin, shown in broken away form in FIG. 1, leads to the contrarotating drive, synchronized by a pair of gear wheels, of the two cutting rollers in in each case opposite rotation directions.

FIG. 1 indicates that the cutting rollers are axially so supported against one another by means of a corresponding axially elastic bearing construction of the bearing block 21 constructed as a joint bearing insert, that they run on one another with minimum friction and also lead to a good cut path, whilst being able to axially yield in the case of overloading.

The cutting disks 14, 15 are ring flange-like, preferably hardened structures projecting over the roller surface 17 of the through roller body 16 and which have a cutting face or edge 22 running substantially in a radial plane and a back edge or face 23 at an angle f with respect to the latter or a radial plane. The faces 22, 23 are interconnected by a cylindrical torus or ring face 24 forming the outer circumference of the cutting disk and which has in the axial direction a relatively small width s.

In the preferred embodiment the cutting disks are in one piece with the roller body. However, it is also possible to arrange them in the form of individual disks on a shaft if this proves to be more favourable for manufacturing reasons. The transition between the back faces 23 and the cutting faces 22 and the roller surface 17 is provided with generous fillets 45 and namely with a radius r, which is larger than 1/5 of the cutting disk height h over the roller surface 17 (preferably, as in the embodiment, approximately ⅓ of h, cf. FIG. 2).

As the cutting disks 14, 15 of the cutting rollers 12, 13 are in each case directed in opposition to one another, the cutting faces 22 of the cutting disk 14 of a cutting roller 12 engage on the corresponding cutting faces 22 of the disk 15 of the cutting roller 13, because they are in each case arranged with the same axial spacing b on both rollers. The cutting faces 22 form between themselves and the ring face or torus 24 an all-round, circular cutting edge 25, which is determinative for the spacing b. The cutting face 22 has a substantially radial configuration, but could also differ from this, provided that a low-friction engagement of the two cutting edge areas is ensured. Thus, it would be possible to have an even more generous fillet. However, it must be ensured that the edge of the strip 28 cut from the introduced flat material can move substantially freely in the opening 29. This opening has a compact trapezoidal shape with angles rounded by the fillets 45, i.e. it is closer to an equilateral trapezium than to an elongated, strip-like trapezium. This is achieved through the relatively steep path of the back faces 23, together with a moderate cutting disk height h.

The cutting rollers 12, 13 are located with an axial spacing A from one another, which is smaller than the external diameter Da. Thus, between the cutting disks is formed a lenticular overlap zone, whose largest dimension is u in the connecting plane of the two cutting disk axes 30 shown in FIG. 2. The dimensions of the opening are also to be understood in this plane, because it has its narrowest point in said plane and widens in front of and behind the same.

The dimensions and dimensional ratios have been tested and tried and the following have proved to be the most favourable values or ranges. Starting from an external diameter of the cutting disks, which for a small workplace shredder can be 25 mm, the cutting disk height h can be approximately 2.5 mm for an axial cutting edge spacing b of 4 mm. For an axial spacing A of 23.5 mm, there is an overlap u of 1.5 mm and therefore a radial dimension d for the opening of 2.5 mm, whilst the dimension a, i.e. the smallest distance between the back faces 23 in the opening 29 can be 2.6 mm. This leads to an almost "square" ratio of the trapezium, whose height and width only differ from one another by approximately 20%. The cutting teeth have a very small height or depth of 2.5 mm, but are adequately stiffened due to the two generous fillets 45, so that they are sufficiently stable even with the face or included angle of 25° and the very small ring face width 24 of s=0.2 mm. This small ring face also makes cutting easier, in that it increases the surface pressure in the cutting area. The relatively small width s of the ring face 24 ensures that no pronounced angles are formed in the opening and which could give the latter a Z-shape. Ranges were also investigated in which the desired favourable results are obtained. For other sizes of the cutting mechanisms, the dimensional ratios which can be calculated from the previously given information are also particularly advantageous. However, the values can also differ therefrom. Thus, it is e.g. possible to choose the face angle between 20° and 35°, without increasing the breakage risk or excessively constricting the opening 29. The favourable ratio between the external diameter Da and the cutting disk spacing b of approximately 6:1 can be up to approximately 10:1 and the width s of the ring face 24 on the cutting disk circumference, which in the embodiment is approximately 8%, can be between 5 and 20% of the cutting disk height and amount to 1/16 to 1/30 and preferably 1/20 of the cutting edge spacing b. A small ratio between the cutting disk height h (projection over the roller surface) is advantageous and should be less than 70% of the cutting edge spacing b. The radial dimension d of the opening should be smaller or roughly the same as the axial cutting edge spacing b. Based on the transverse spacing a, i.e. the spacing between the back faces, these radial dimensions d should be smaller than 1/5 and preferably smaller than twice a.

Based on the cutting disk height h, the overlap u should be less than 2/3 thereof or, based on the axial cutting edge spacing b or the radial dimension d of the opening, less than half said values.

Further dimensions and ratios can be gathered from the claims and drawings, to which reference is made.

The cutting mechanism functions in the following way. An inserted sheet or sheet layer or a web or web layer (in the case of continuous loading) passes, optionally guided by the walls of an insertion slot, into the over-lap region between the two cutting rollers, i.e. vertically in the plane of the drawing. It is grasped by the contrarotating cutting rollers, i.e. pulling in the same direction and, if this should prove necessary for conveying purposes, the ring face 24 could be serrated. Thus, it is drawn between the two rollers and upstream of the median plane connecting the two axes 30 it is cut in the manner of a scissor cut at the start of the lenticular overlap region by the two cooperating cutting edges 24 of each cutting disk pair. It is advantageous for the cut to take place simultaneously over the entire width, so that the material is held taut between the individual cutting edges and consequently even in the case of somewhat blunt and not completely engaging cutting edges it is cut or torn in cutlike manner. This is assisted by the fact that following the cutting process the ring faces 24, which are adjacent to the particular cut line, reciprocally move apart, so that the material would be separated as a result of the significant stretching which then occurs.

The resulting paper strip 28, on reaching the median plane of the two cutting rollers, is inclined compared with its orientation prior to the cutting process (corresponding to the separating plane 35), as shown in FIG. 2, so that there is a slight helical rotation of the resulting strip and this has led to the name "torsion cut" for this roller construction. This helical turning tendency is relatively small in the case of the cutting mechanism according to the invention, i.e. the "pitch" of the resulting helix is very large. It is clear that the strip 28 could also assume a different position without jamming between the walls of the opening. This is assisted by the generous fillets 45. Even a roughened or corrugated edge could not lead to jamming. In particular, independently of the residual helical shape of the strip and which is dependent on the material characteristics, said strip can be placed in a virtually random rotary position without running up the wall of the opening.

The cutting mechanism according to the invention does not require a stripper. A stripper would only be provided in the case of very critical materials which, for other reasons, tend to stick to the cutting rollers.

It is also pointed out that the compact shape of the opening could be maintained or even further extended, if the opening, diverging from its represented trapezoidal shape, was more adapted to a rectangular or preferably circular or elongated shape. For this purpose the previously cylindrical roller surface 17 between the cutting disks by corresponding turning could be given the rounded shape 36 indicated in dot-dash line manner in FIG. 2, without impairing the cutting disk strength. The strip could then move freely in the opening by more than 60°. The generous fillets 45 would then almost form a full circle. The advantages of the invention can also be obtained through a good fillet in the space forming the opening independently of the relative dimensions of the latter.

We claim:

1. A cutting mechanism for a document shredder with two cutting rollers rotatable around axes, which have cutting disks arranged with an axial spacing from one another and projecting from the roller surface, each of said cutting disks comprising a substantially radial cutting face terminating in a continuous circumferential cutting edge and a bevelled back face, each cutting edge of a cutting disk of one of said cutting rollers overlapping an oppositely directed cutting edge of a cutting disk of the other of said cutting rollers and cooperating therewith for cutting a flat material introduced between the cutting rollers into strips; a passage for each of said strips being bounded by the cutting face and the back face of adjacent cutting disks and the roller surfaces of both cutting rollers, said passage having a compact shape wherein a first perpendicular distance between opposing back faces and a second perpendicular distance between centers of the roller surfaces being approximately equal.

2. A cutting mechanism according to claim 1, wherein two back faces of two cutting disks limiting the passage have at the narrowest point of the passage a larger spacing from each other than 60% of the axial spacing between adjacent cutting edges of the same cutting roller.

3. A cutting mechanism according to claim 1, wherein spacing between the back faces at the narrowest point of the passage is larger than $\frac{2}{3}$ of cutting disk height over the roller surface.

4. A cutting mechanism according to claim 1, wherein spacing between the back faces at the narrowest point of the passage is larger than approximately 40% of the radial dimensions of the passage at said narrowest point.

5. A cutting mechanism according to claim 4, wherein the back face spacing is approximately 75% of the radial dimensions.

6. A cutting mechanism according to any one of the preceding claims, wherein the transitions between the roller surface and the back face and the cutting face are provided with fillets.

7. A cutting mechanism according to claim 6, wherein the fillets having a radius being larger than 1/5 of cutting disk height above the roller surface.

8. A cutting mechanism according to claim 1, wherein the cutting rollers are synchronously contrarotated at the same speed.

9. A cutting mechanism according to claim 1, wherein each cutting disk comprises an outer circumference interconnecting the cutting and back faces which forms a ring face, the axial width of which being smaller than 1/5 of the cutting disk height above the roller surface.

10. A cutting mechanism according to claim 1, wherein each cutting disk comprises an outer circumference connecting the cutting and back faces, which forms a substantially cylindrical ring face, the width of which being smaller than 1/6 of the axial spacing between cutting edges of adjacent cutting disks of the same cutting roller.

11. A cutting mechanism according to claim 10, wherein the width of the ring face is between 1/15 and 1/30 of said axial spacing.

12. A cutting mechanism according to claim 1, wherein an angle between the bevelled back face and an axis of the cutting roller is between 70° to 55°.

13. A cutting mechanism according to claim 1, wherein height of the cutting disk above the roller surface is less than 70% of axial spacing between cutting edges of adjacent cutting disks of the same cutting roller.

14. A cutting mechanism according to claim 1, wherein radial dimensions of the passage at its narrowest point are smaller or the same as the axial spacing between cutting edges of adjacent cutting disks of the same cutting roller.

15. A cutting mechanism according to claim 1, wherein the radial dimensions of the passage at its narrowest point are smaller than five times of spacing between the back faces in the passage.

16. A cutting mechanism according to claim 1, wherein the overlap defined in a connecting plane containing the two cutting roller axes by radial spacing of the cutting edges of cooperating cutting disks is smaller than $\frac{2}{3}$ of cutting disk height above the roller surface.

17. A cutting mechanism according to claim 1, wherein the overlap defined in a connecting plane containing the two cutting roller axes by radial spacing of the cutting edges of cooperating cutting disks is smaller than half of axial cutting edges spacing.

18. A cutting mechanism according to claim 1, wherein the overlap defined in a connecting plane containing the two cutting roller axes by radial spacing of the cutting edges of cooperating cutting disks is smaller than half of radial dimensions of the passage at its narrowest point.

19. A cutting mechanism according to claim 1, wherein the cutting disk has a diameter, which is smaller than 10 times the axial spacing of the cutting edges of adjacent cutting disks of the same cutting roller.

20. A cutting mechanism according to claim 1, wherein the cutting disk has a diameter, which is smaller than 12 times the cutting disk height above the roller surface.

21. The cutting mechanism of claim 1, wherein a periphery of the passage is substantially a parallelogram with rounded corners.

22. The cutting mechanism according to claim 1, wherein a periphery of the passage is substantially an ellipse.

23. The cutting mechanism according to claim 20, wherein a periphery of the passage is substantially a rhombus.

24. The cutting mechanism according to claim 21, wherein a periphery of the passage is substantially a circle.

25. The cutting mechanism according to claim 1, wherein the ratio of the first distance to the second distance is greater than 80%.

26. The cutting mechanism according to claim 1, wherein the ratio of the first extension to the second extension is greater than 75%.

* * * * *